US005165357A

United States Patent [19]

Kawasaki

[11] Patent Number: 5,165,357

[45] Date of Patent: Nov. 24, 1992

[54] STREAMLINED TUG-AND-BARGE LINKAGE

[76] Inventor: Masasuke Kawasaki, 1002 Michigan Ave., Slidell, La. 70458

[21] Appl. No.: 867,813

[22] Filed: Apr. 13, 1992

[51] Int. Cl.[5] ..... B63B 21/00

[52] U.S. Cl. ..... 114/248

[58] Field of Search ..... 114/242, 248, 249, 250

[56] References Cited

U.S. PATENT DOCUMENTS 3,568,621 3/1971 Kawasaki ..... 114/248
4,326,479 4/1982 Kawasaki ..... 114/248
4,407,214 10/1983 Kawasaki ..... 114/249

*Primary Examiner*—Jesus D. Sotelo
*Attorney, Agent, or Firm*—Arnold, White & Durkee

[57] ABSTRACT

A linkage is provided for connecting a first vessel and a second vessel such that the vessels are inhibited from rolling or yawing relative to one another but are permitted to pitch and heave relative to one another, when the first vessel is pushed by the second vessel via the linkage. The linkage also provides a streamlined transition from the rear of the first vessel to the second vessel to reduce drag and thereby reduce power requirements of the pushing vessel. The linkage is also adapted to function as a skeg to decrease the yaw of the first vessel when the first vessel is pulled by a second vessel. When used to link a pushing vessel with a pushed vessel, the linkage of this invention provides a pedestrian walkway and apparatus for transferring fluids between the two vessels.

15 Claims, 3 Drawing Sheets

STREAMLINED TUG-AND-BARGE LINKAGE

BACKGROUND OF THE INVENTION

The invention relates to an apparatus for towing sea-going vessels, and more particularly it relates to linkages for utilization during the towing by pushing, and to skegs for utilization during the towing by pulling, of non-propelled barges by tugboats.

Non-propelled barges are powered through the water by either pushing the barge from the stern by a tugboat or by pulling the barge at the end of a line connected between the stern of the tugboat and the bow of the barge. The former method is usually accomplished by connecting the tugboat to the stern of the barge by a suitable linkage such as is illustrated in Applicant's U.S. Pat. No. 3,568,621, U.S. Pat. No. 4,407,214, and U.S. Pat. No. 4,326,479, which are incorporated by reference. The combined vessels then act effectively as one and navigation is accomplished through controls on the tugboat.

Barges pulled on a line, however, are free to oscillate from side-to-side around a vertical axis of rotation (yaw). If the amplitude of oscillation is small, then the condition is not serious. At times, though, a yawing barge can swing in a path having a width two to three times the length of the barge. Such substantial yawing has been known to capsize tugboats and even barges. To overcome this problem, skegs may be included on non-motorized barges wherein towing of the barge by pulling is anticipated. (Skegs are fin-like protrusions, usually attached as a parallel pair to the stern of the barge, which have a substantially vertical orientation and which are substantially aligned with the path of travel). While skegs help to reduce yawing drastically, they also offer additional water resistance.

Hence, to provide an improved apparatus for towing barges, both by pushing and by pulling, it is desirable to provide a device which adequately connects the tug to the barge when the barge is pushed and which functions as a stabilizing skeg to reduce yawing of the barge when it is pulled, and which minimizes water resistance in both cases.

Where the barge is pushed by a tugboat, prior tugboat and barge linkages have usually allowed freedom of movement for relative pitching, heaving and rolling. Such movement was generally permitted because it was believed to be advantageous to allow the tugboat to exhibit such independent response relative to the barge. It has been found, however, that in many instances the relative rolling, i.e. independent rotation around an axis along the centerline of the vessels, should be reduced to a bare minimum. When complete freedom of rolling is allowed, the tug often sustains excessive roll far beyond an acceptable range during steering.

There have been proposals to overcome the problem of relative rolling by means of a truss reinforced frame extending rearwardly from a barge and attaching directly to either side of the tugboat. Such an arrangement, however, requires a highly rugged construction.

It has further been proposed to provide mating surfaces, such as a barge having a stern recess to receive the bow of a tugboat as shown in Applicant's U.S. Pat. No. 3,568,621, in order to minimize roll. While such an arrangement is effective to preclude or inhibit rolling of the tugboat relative to the barge, the required surface area for the mating surfaces must be large because of the many variables which determine where the mating surfaces will contact. That is, the relationship between the surfaces is dependent upon the draft of each vessel, the pitching of the barge, the pitching of the tugboat, and the pivotal motion of the linkage, whether due to heaving or pitching of either of the vessels. The combination of all of these relative motions may therefore require, for example, a large slot in the barge stern with a suitable mating protrusion at the bow of the tugboat for a tugboat-barge combination, similar to that shown in applicant's patent, U.S. Pat. No. 3,568,621.

To provide an improved linkage for barges and tugboats, wherein it is desired to push a non-propelled barge by a tugboat, applicant previously conceived of a series of devices which eliminated the need for extended mating surfaces in the stern of the barge, one which provided readily defined mating surfaces, and one which lessened the strength requirements of the linkage structure. A number of such devices are shown in applicant's U.S. Pat. No. 4,407,214. That patent disclosed a rearwardly extending linkage frame pivotally secured to the stern of the barge along a substantially horizontal axis generally parallel to the stern of the barge. The linkage defined a recess generally facing the bow of the tugboat. Means were provided for aligning the bow or a member of the bow of the tugboat with a recess in the rear face of the linkage such that roll of the tugboat relative to the barge was minimized. Additionally, the apparatus disclosed in that patent included a means for securing the tugboat to the linkage such that freedom of movement for pitching and heaving of the tugboat relative to the barge is permitted. While the devices shown in U.S. Pat. No. 4,407,214 operated to properly restrict the freedom of relative motion between the tugboat and the barge, the devices generally continued to require mating surfaces on the tugboat, and they adversely increased the water resistance exerted against the tugboat and linkage.

Hence, to provide an improved apparatus for barges which may be towed by both pushing and pulling, it is desirable to provide a device which minimizes both water resistance and rolling of the barge relative to the tugboat while allowing freedom of movement for relative pitching and heaving, without requiring extended mating surfaces on either the barge of the tugboat.

One partial approach to lessening water resistance is shown in applicant's U.S. Pat. No. 4,326,479, which discloses the use of a flow flap positioned between the stern of the barge and the bottom rear edge of a linkage. This arrangement creates a continuous surface between the barge and the tugboat hull in order to lessen water resistance between the barge and the tugboat when the barge was pushed. It also requires, however, an elongated mating slot in the stern of the barge and a corresponding mating member at the bow of the tugboat. It is therefore desirable to provide an apparatus which minimizes water resistance without the provision of elongated slots and mating members.

It is further desirable to provide a linkage device which may alternatively function as a stabilizing skeg to reduce yawing of the barge when it is pulled, while providing minimized water resistance when the barge is either pushed or pulled.

It is also desirable to provide a device which allows safe pedestrian passage between the tugboat and the barge, and which allows reliable transfer of fluids between the tugboat and the barge, regardless of the relative draft and the relative motions of the two vessels.

It is still further desirable that the skeg portions be easily moved from their inward position, for use during barging pushing, to their outward position, for use as stabilizing skegs during barge pulling.

SUMMARY OF THE INVENTION

The present invention provides the above desired advantages through an apparatus which functions as a streamlined linkage for coupling first and second vessels when the first vessel is pushed by the second vessel, and alternatively as a skeg to stabilize the first vessel when the first vessel is pulled by the second vessel. The linkage of the present invention may be coupled to conventional barges and tugboats without substantial alterations to the structure of either vessel.

When used as a linkage to couple a pushed vessel to a pushing vessel, the apparatus of this invention minimizes roll of one vessel relative to the other while permitting freedom of movement for pitching and heaving of one vessel relative to the other. More specifically, the apparatus provides a means of coupling a tugboat to a non-propelled barge for pushing the barge which minimizes roll of the tugboat relative to the barge while permitting freedom of movement for pitching and heaving of the tugboat relative to the barge. The apparatus simultaneously minimizes water resistance by shielding the front of the tugboat with a streamlined structure which acts as a continuation of the rear portion of the barge hull, presenting a generally continuous smooth surface from the hull of the barge to the amidships hull of the tugboat. For simplicity, reference will be made to a tugboat, which will hereafter refer to a second or pushing vessel, and a barge, which will hereafter refer to a first or lead vessel. It should be apparent, however, that the structure could function to connect any two seagoing vessels, such as two barges, if desired.

The apparatus of the present invention includes a streamlined nose housing pivotally connected to the barge and adapted to receive and engage the bow of the tugboat over a range of vertical positions of the tugboat relative to the barge. The tugboat is pivotally connected to the nose housing through linkage arms such that the tugboat may pivot with respect to the housing about a generally horizontal axis transverse to the tugboat, eliminating the need for extended mating surfaces. The housing may also include a streamlined extension member extending beneath a portion of the tugboat when the tugboat is positioned in the apparatus. The linkage of this invention may further be adapted to provide for pedestrian access between the barge and the tugboat by means of a walkway constructed along an upper surface of the linkage. The linkage may still further include conduits adapted to convey fluids, such as fuel and water, or electrical cables, between the barge and the tugboat.

The linkage arms of the present invention are further adapted to function as skegs when the barge on which the linkage is installed is pulled. Specifically, the linkage arms are pivotally connected to the nose housing such that, when used as skegs to reduce yawing of a barge being pulled by a tugboat, the linkage arms may be pivoted and secured outward from parallel to the longitudinal centerline of the vessels and allowed to ride partially submerged in the water. In this position the linkage arms act as fins to ensure that the barge properly tracks the tugboat. The streamlined linkage acts as a continuation of the rear portion of the barge hull and minimizes the water resistance attributable to the skegs.

BRIEF DESCRIPTION OF THE DRAWINGS

So that the manner in which the herein described advantages and features of the present invention, as well as others which will become apparent, are attained and can be understood in detail, more particular description of the invention summarized above may be had by reference to the embodiment thereof which is illustrated in the appended drawings, which drawings form a part of this specification.

It is to be noted, however, that the appended drawings illustrate only exemplary embodiments of the invention and are therefore not to be considered limiting of its scope, for the invention may admit to other equally effective embodiments.

DETAILED DESCRIPTION OF THE PREFERRED EMBODIMENTS

A linkage in accordance with this invention is characterized by a streamlined nose housing which is pivotally mounted about a first horizontal axis to the aft end of a barge, the housing having a convex forward surface and a concave aft surface. Linkage arms are pivotally connected to the nose housing, extending rearwardly from each side of the housing. A tugboat may be received by the linkage such that the nose of the tugboat approaches or engages the aft surface of the nose housing, and connecting means on the linkage arms engage the sides of the tugboat to pivotally hold it in position.

Figure 1:
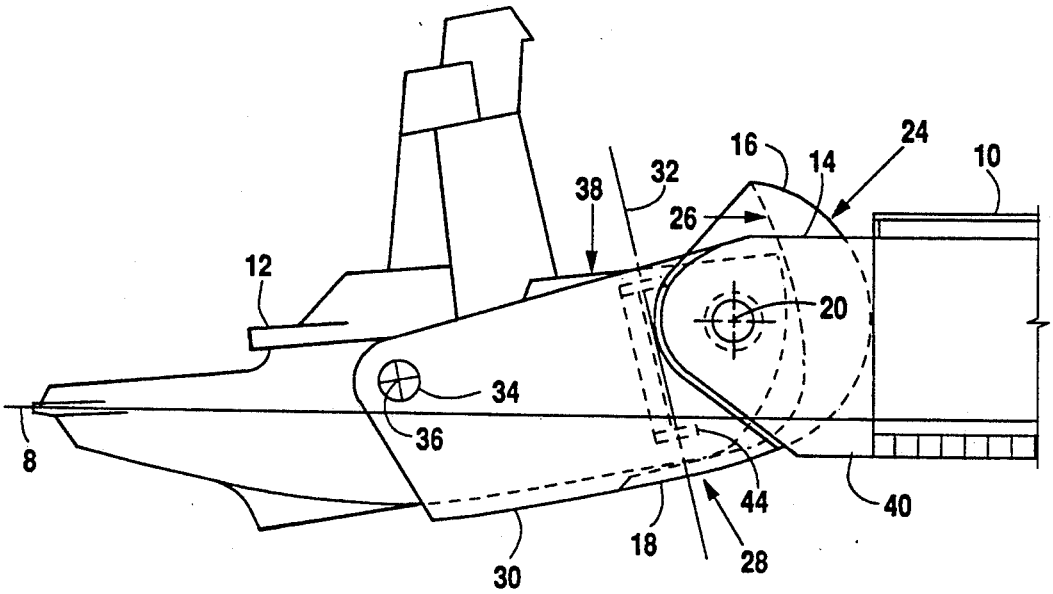
FIG. 1 is a side elevation view of a linkage according to this invention, attached to the stern of a barge and engaging a tugboat, illustrating the position of the linkage and the relative positions of the vessels when the tugboat is relatively low with respect to the barge.

Referring to FIG. 1, this invention provides a linkage to connect first vessel 10, which is ordinarily a barge, to second vessel 12, which is ordinarily a tugboat used to push the barge. This linkage could also be used, for example, to connect two barges together. (For ease of understanding, the first vessel will be referred to herein as the barge 10 and the second vessel will be referred to herein as the tugboat 12). The aft end of barge 10 is equipped with a supporting structure 14 which is adapted to pivotally support nose housing 16. Supporting structure 14 may be integrally constructed as part of barge 10, or supporting structure 14 may be attachable to the stern or a barge, by methods known in the art.

In a preferred embodiment, a stern projection 40 may extend rearwardly from the bottom of the rear of barge 10 such that the lower surface of projection 40 is substantially a continuation of the hull of barge 10. Stern projection 40 assists in streamlining the linkage by inhibiting water flow between the aft end of the bottom of barge 10 and supporting structure 14 and the forward surface 24 of nose housing 16.

Nose housing 16 is adapted to pivot around a first horizontal axis 20 over a range of motion that will accommodate the range of relative vertical positions anticipated between barge 10 and tugboat 12. FIG. 1 illustrates the circumstance where the barge 10 is empty and riding high in the water, as can be seen by water line 8 crossing low on the barge. Tugboat 12 in FIG. 1 is illustrated as being fully loaded and riding at its lowest position relative to water line 8 (compare FIG. 4, which illustrates barge 10 riding low in the water and tugboat 12 riding high).

The forward surface 24 of nose housing 16 is generally spherical or arcuate in shape, such that as housing 16 pivots about first horizontal axis 20, the clearance between the forward surface of the housing 16 and the rear surfaces of barge 10 and supporting structure 14 is kept to a minimum to inhibit water flow between the surfaces over the anticipated range of motion between the housing 16 and the barge 10. This is accomplished by making the shape of forward surface 24, in a vertical plane normal to the first horizontal axis, an arc of generally constant radius having its center of curvature at the first horizontal axis 20.

Two generally vertical linkage arms 30 extend rearwardly from the lateral sides of nose housing 16. Each linkage arm 30 is pivotally connected to nose housing 16 by hinge 44 having a generally vertical axis 32. Each linkage arm 30 is equipped proximate its aft end with a connector 34 by which the linkage arm can be pivotally connected to the side of a tugboat 12, as will be known to those of skill in the art. Connectors 34, in association with corresponding receiving structures on the sides of tugboat 12, are adapted to allow tugboat 12 to freely pivot around a second horizontal axis 36 relative to the linkage arms 30. Each linkage arm 30 may have a compartment 42 constructed therein for storage of equipment or material within the linkage arm 30. Compartment 42 may be adapted to store liquids, particularly fuel or water for use by the tugboat and crew during a long voyage.

Hinge 44, which connects linkage arms 30 to nose housing 16, allows linkage arms 30 to pivot outwardly away from the centerline of the vessels to make way for tugboat 12 to enter the linkage, and allows linkage arms 30 to pivot inwardly to connect linkage arms 30 to tugboat 12 using connectors 34. Compare FIGS. 2 and 6, which illustrate linkage arms 30 in their inwardly and outwardly pivoted positions, respectively.

Figure 2:
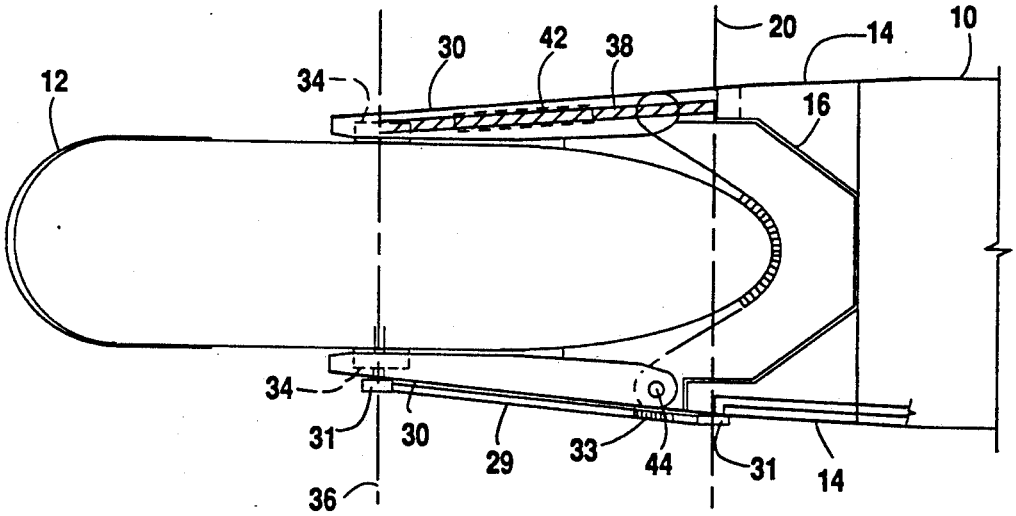
FIG. 2 is a plan view of the linkage according to this invention attached to the stern of a barge and engaging a tugboat.

Referring to FIGS. 1 and 2, in a preferred embodiment one or both linkage arms 30 and a lateral portion of nose housing 16 may be adapted to provide a walkway 38 for pedestrian access between tugboat 12 and barge 10. A structure may be provided near the point where the linkage arms 30 are connected to the sides of tugboat 12 to provide access between walkway 38 and the deck of tugboat 12. The forward end of walkway 38, where it crosses a portion of nose housing 16, tangentially intersects and is generally flush with the upper surface of supporting structure 14 regardless of the pitching and heaving motions of the vessels.

In a preferred embodiment, as shown in FIG. 2, a conduit 29 for conveying liquids or electrical cables may be disposed between tugboat 12 and barge 10. When tugboat 12 is in position between linkage arms 30 and engaged by the connectors 34, there are three well defined axes of motion between the vessels and the linkage (two horizontal axes 20 and 36 and vertical axis 44). By positioning a moveable joint in the conduit as these pre-determined locations of articulation, such as, for example, a concentric swivel 31 or a flexible connector 33 (as are known in the art), conduit 29 may be used to convey fluids or to support cables between the two vessels regardless of the relative horizontal positions of the vessels, and regardless of the relative motion of the two vessels. The conduit may be positioned external to the linkage structure, as shown in FIG. 2, or alternatively may be positioned within the linkage members. In addition, if desired, compartments 42 may be constructed in linkage arms 30 in order to provide additional capacity for storage of materials, such as, for example, fuel and water. Conduit 29 as described provides a reliable connection for transfer of fluids between tugboat 12 and barge 10 and allows large quantities of fuel and water to be carried on the barge and conveyed to the tugboat as needed. By also providing a walkway 38 across the linkage, as described herein, even living quarters may be provided on barge 10 making the system especially well-suited for very long voyages.

FIG. 2 shows linkage arms 30 in their inwardly pivoted position, with a connector 34 pivotally connecting each linkage arm 30 to a suitable mating apparatus installed on the side of tugboat 12.

Figure 3:
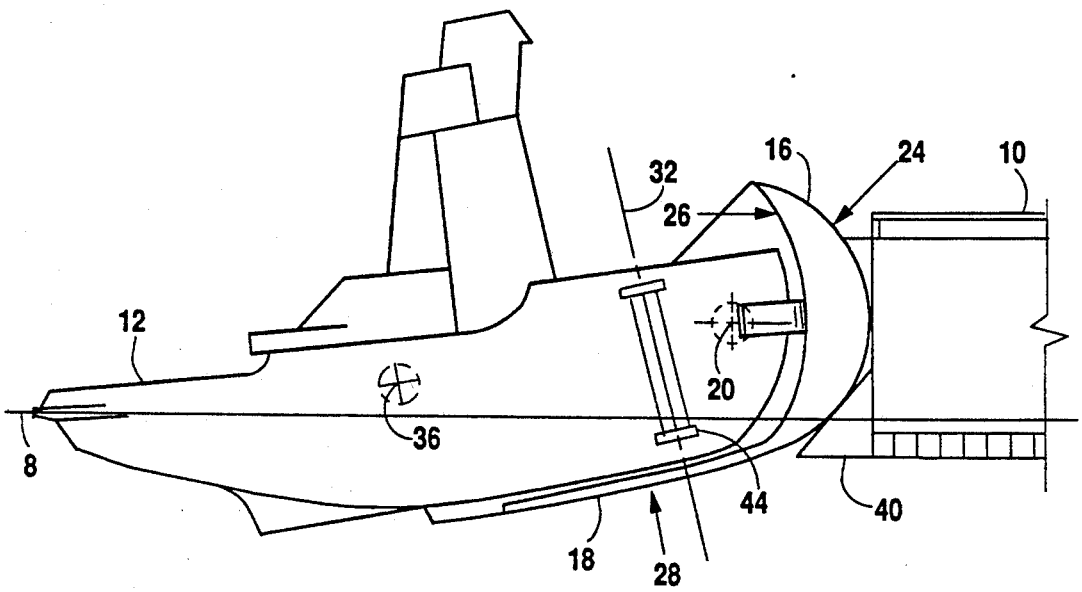
FIG. 3 is a cross-sectional side view of the configuration shown in FIG. 1.

Referring to FIG. 3, which shows a cross-sectional elevation view of a linkage according to this invention, the aft surface 26 of nose housing 16 is adapted to be engaged or approached by the nose of tugboat 12 when tugboat 12 is in position between linkage arms 30 and connectors 34 engage tugboat 12. To accomplish this, the portion of aft surface 26 that is to be engaged by the bow of the tug is arcuate in vertical longitudinal cross section with a generally constant radius having a center of curvature at second horizontal axis 36. This allows the nose of tugboat 12 to remain near or engaged with aft surface 26 of nose housing 16 as tugboat 12 pitches relative to the linkage about second horizontal axis 36.

FIG. 3 also illustrates a preferred embodiment, with rearwardly extending member 18 extending from the lower portion of housing 16. Rearwardly extending member 18 serves to further streamline the water flow across the transition from the hull of barge 10 to the hull of tugboat 12. A continuous smoothly curved surface is created by forward surface 24 of nose housing 16 and lower surface 28 of rearwardly extending member 18. The lower surface 28 of rearwardly extending member 18 is designed to generally tangentially accept the water flowing off of the lower surface of stern projection 40 and to direct it aft along the hull of tugboat 12 to minimize turbulence and drag. In a preferred embodiment, the forward portion of the tugboat 12 is substantially enclosed by nose housing 24, rearwardly extending member 18, and linkage arms 30, so that the linkage and the hull of tugboat 12 effectively act as an extension of the barge 10 hull.

Figure 4:
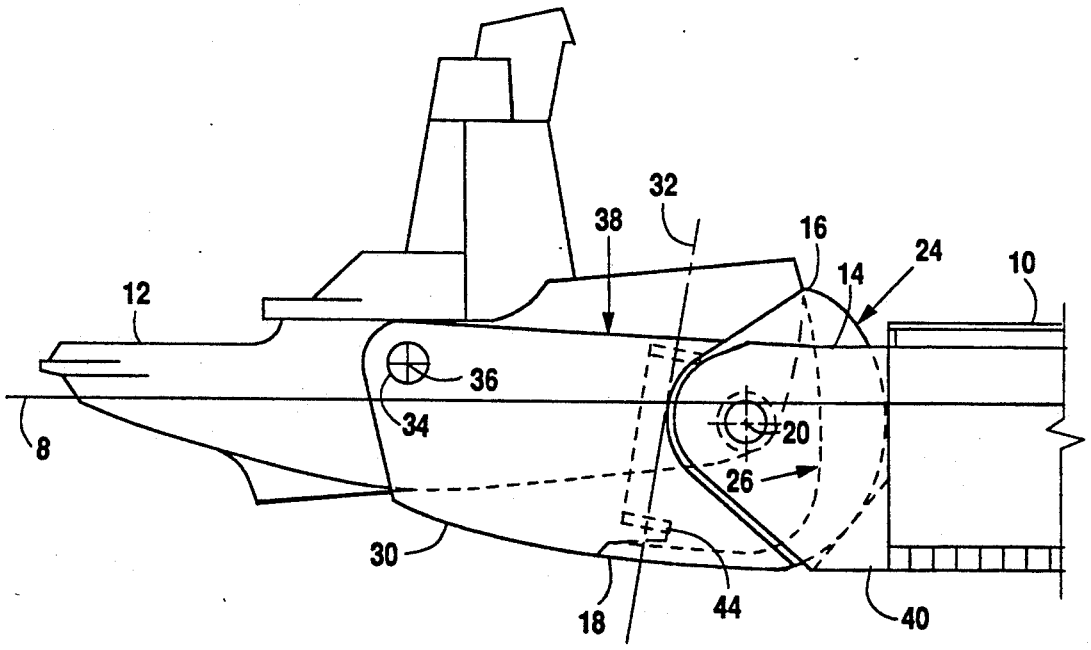
FIG. 4 is a side elevation view of the linkage according to this invention attached to the stern of a barge and engaging a tugboat, illustrating the position of the linkage and the relative positions of the vessels when the tugboat is relatively high in the water with respect to the barge.
Figure 5:
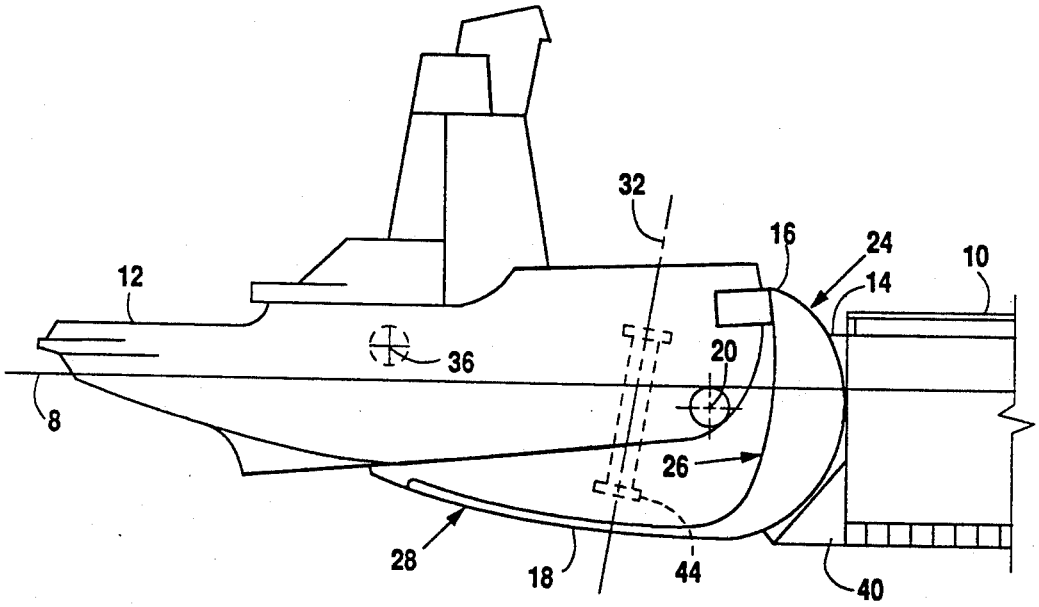
FIG. 5 is a cross-sectional side view of the subject matter of FIG. 4, illustrating the engagement of the bow of the tugboat with the upper portion of the nose housing.

FIG. 4 illustrates the relative positions of tugboat 12, the linkage of this invention and barge 10 when tugboat 12 is light and riding high relative to water line 8 and barge 10 is fully loaded and riding low relative to water line 8. In this situation, the bow of tugboat 12 engages aft surface 26 of nose housing 16 near its top edge. FIG. 5 shows this configuration in cross-section. Note that, due to the generally constant radius of curvature of aft surface 26 of nose housing 16 centered on second horizontal axis 36, the bow of tugboat 12 remains near or engaged with aft surface 26 regardless of the relative vertical positions of the two vessels. Similarly, the generally constant radius of forward surface 24 of nose housing 16, with its center of curvature at first horizontal axis 20, allows the forward surface 24 of nose housing 16 to remain in close proximity to the rear of barge 10 and supporting means 14 as well as in close proximity with the aft edge of stern projection 40. (Compare FIG. 5 and FIG. 3, which show that close clearances are maintained regardless of the relative drafts of the vessels).

Thus, regardless of the relative vertical positions of the two vessels, a streamlined connection between the two vessels is provided by this linkage. Note, especially in FIG. 5, that the lower surface of stern projection 40, the lower portion of forward surface 24 of nose housing 16, and the lower surface 28 of rearwardly extending member 18 operate to provide a substantially continuous surface along the underside of the combined vessels such that water will flow smoothly and with minimal turbulence from the hull of barge 10, along the bottom surfaces of stern projection 40 and the linkage, and then along the rear portion of the hull of tugboat 12.

Referring to FIG. 2, when tugboat 12 is used to push a barge 10 using the linkage according to this invention, in a preferred embodiment, the majority of the thrust force transmitted from tugboat 12 to barge 10 may be transmitted through connecting means 34 and linkage arms 30. This alternative has the advantage that the bow of tugboat 12 may move freely with respect to aft surface 26 of nose housing 16, permitting the tug to freely pitch and heave relative to the linkage without friction between the bow of tugboat 12 and aft surface 26 of nose housing 16. If desired, the freedom of movement of the bow of tugboat 12 may be suppressed by tying tugboat 12 and the linkage together with mooring lines.

In an alternative embodiment, thrust forces may be transmitted from tugboat 12 to barge 10 primarily through the bow of tugboat 12 pushing on the aft surface 26 of housing 16. In this embodiment, connectors 34 may be adapted to allow a degree of fore and aft motion of tugboat 12 relative to linkage arms 30 when linkage arms 30 are connected to tugboat 12 by said connectors 34. The degree of freedom of relative fore and aft motion required is minimized by the generally constant radius of curvature of the aft surface 26 of nose housing 16.

Figure 6:
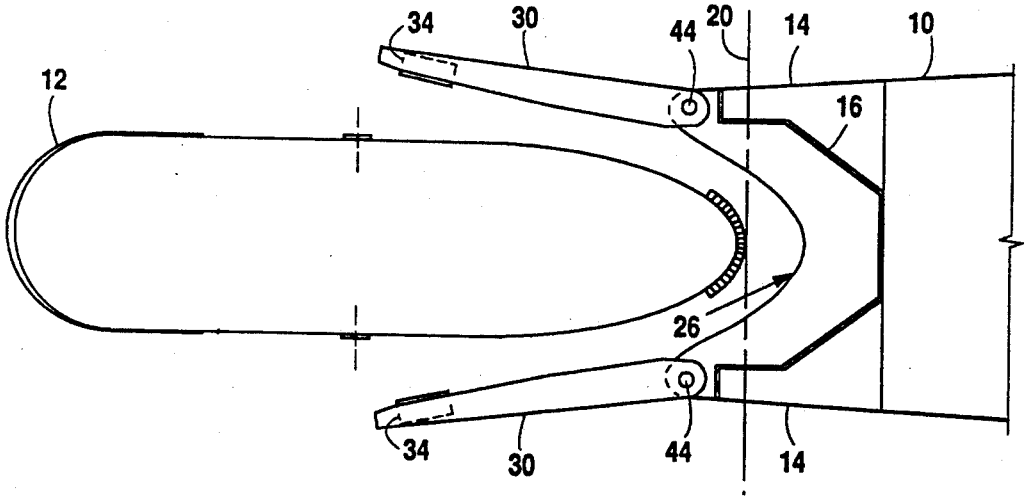
FIG. 6 is a plan view of the linkage according to this invention attached to the stern of a barge with the linkage arms swung outwardly away from the sides of the tugboat.

FIG. 6 illustrates linkage arms 30 pivoted at hinge 44 outwardly from tugboat 12. This is the position in which linkage arms 30 may be placed to allow tugboat 12 to move into or out of engagement with the linkage, or to function as skegs when the barge is pulled.

In a preferred embodiment, hinge 44, which allows the linkage arms 30 to pivot around a generally vertical axis 32, is tilted outwardly, away from the centerline of the vessels, at the upper end of hinge 44. This causes linkage arms 30 to tend to swing outwardly away from tugboat 12 under the force of gravity when connectors 34 are released from the sides of tugboat 12.

The linkage of this invention also functions as a skeg to reduce the yaw of a barge 10 equipped with the linkage when barge 10 is pulled by a tugboat. When used as a skeg, the linkage arms 30 are secured in their outwardly pivoted positions as shown in FIG. 6. With linkage arms 30 in this position, linkage arms 30 will function as skeg fins, and the broad streamlined surfaces of the linkage arms 30, nose housing 16, and rearwardly extending member 18 minimize drag caused by the skeg.

Further modifications and alternative embodiments of this invention will be apparent to those skilled in the art to view of this description. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size and arrangement of parts. For example, equivalent elements or materials may be substituted for those illustrated and described herein, and certain features of the invention may be utilized independently of the use of other features, all as would be apparent to one skilled in the art after having the benefit of this description of the invention.

What is claimed is:

1. A streamlined linkage for coupling a first vessel and a second vessel, each such vessel having a bow and a stern, comprising:

a nose housing pivotally securable to the stern of a first vessel and adapted to pivot around a first generally horizontal axis transverse to the first vessel, the housing having a generally convex forward surface and a generally concave aft surface, wherein the forward surface of the nose housing is arcuate in vertical longitudinal cross section having a radius of curvature centered at the first horizontal axis, and wherein the aft surface of the nose housing is adapted to receive the bow of the second vessel over a range of relative vertical positions between the first vessel and the second vessel;

two linkage arms having forward and aft ends, the arms being pivotally connected at their forward ends to laterally opposite sides of the nose housing and extending substantially astern from the nose housing, and each arm being further adapted to pivot about a generally vertical axis outward from and inward toward a longitudinal centerline of the vessels; and the linkage arms having connectors adapted to pivotally connect the linkage arms to the second vessel such that the second vessel is free to pitch with respect to the linkage about a second generally horizontal axis passing through the connectors and transverse to the second vessel.

2. The linkage of claim 1, wherein the nose housing comprises a member extending rearwardly from a bottom edge of the nose housing and adapted to extend beneath a portion of the second vessel and to provide a continuous streamlined surface from the forward surface of the nose housing to the rear edge of the rearwardly extending member.

3. The linkage of claim 1, further comprising a supporting structure adapted to pivotally support the nose housing and adapted to be coupled to the stern of the first vessel.

4. The linkage of claim 3, further comprising a walkway constructed along an upper surface of a linkage arm, the nose housing and an upper surface of the supporting structure, adapted to provide pedestrian access between the first and second vessels.

5. The linkage of claim 1, wherein the aft surface of the nose housing is arcuate in vertical longitudinal cross section, having a radius of curvature centered at the second horizontal axis.

6. The linkage of claim 1, wherein the linkage arms are adapted to be selectively fixed in an outwardly pivoted position.

7. The linkage of claim 1, further comprising an articulated conduit attached to the linkage and adapted to conduct fluids between the first vessel and the second vessel, the conduit having movable joints to accommodate relative motion between the first vessel and the linkage around the first horizontal axis and between the linkage and the second vessel around the second horizontal axis.

8. The linkage of claim 1, wherein each generally vertical axis inclines outwardly at its upper end away from a longitudinal centerline of the vessels.

9. The linkage of claim 5, wherein the nose housing comprises a member extending rearwardly from a bottom edge of the nose housing and adapted to extend beneath a portion of the second vessel and to provide a continuous streamlined surface from the forward surface of the housing to the rear edge of the rearwardly extending member.

10. The linkage of claim 5, further comprising a supporting structure adapted to pivotally support the nose housing and adapted to be coupled to the stern of the first vessel.

11. The linkage of claim 10, further comprising a walkway constructed along an upper surface of a linkage arm, the lateral margin of the nose housing and an upper surface of the supporting means, adapted to provide pedestrian access between the first and second vessels.

12. The linkage of claim 5, wherein the linkage arms are adapted to be selectively fixed in an outwardly pivoted position.

13. The linkage of claim 5, further comprising an articulated conduit attached to the linkage and adapted to conduit fluids between the first vessel and the second vessel, the conduit having movable joints to accommodate relative motion between the first vessel and the linkage around the first horizontal axis and between the linkage and the second vessel around the second horizontal axis.

14. The linkage of claim 5, wherein each generally vertical axis inclines outwardly at its upper end away from a longitudinal centerline of the vessels at its upper end.

15. A streamlined linkage for coupling a first vessel and a second vessel, each vessel having a bow and a stern, comprising:

a nose housing pivotally securable to the stern of a first vessel and adapted to pivot around a first generally horizontal axis transverse to the first vessel, the nose housing having an aft surface adapted to receive and engage the bow of the second vessel over a range of relative vertical positions between the first vessel and the second vessel;

two linkage arms having forward and aft ends, the arms being pivotally connected at their forward ends to laterally opposite sides of the nose housing and extending substantially astern from the nose housing, and each arm being further adapted to pivot about a generally vertical axis outward from and inward toward a longitudinal centerline of the vessels, and each arm still further adapted to function as a skeg when the first vessel is pulled by the second vessel; and the linkage arms having connectors adapted to pivotally connect the linkage arms to the second vessel such that the second vessel is free to pitch with respect to the linkage about a second generally horizontal axis passing through the connecting means and transverse to the second vessel.

* * * * *

UNITED STATES PATENT AND TRADEMARK OFFICE

CERTIFICATE OF CORRECTION

PATENT NO. : 5,165,357

DATED : November 24, 1992

INVENTOR(S) : Masasuke Kawasaki

It is certified that error appears in the above-identified patent and that said Letters Patent is hereby corrected as shown below:

Column 10, line 1 (claim 13), "conduit" should be --conduct--.

Signed and Sealed this

Twenty-sixth Day of October, 1993

*Attest:*

Bruce Lehman

BRUCE LEHMAN

*Attesting Officer*

*Commissioner of Patents and Trademarks*